United States Patent [19]

Wertelewski et al.

[11] 3,971,225

[45] July 27, 1976

[54] MINE SUPPORT ASSEMBLIES

[75] Inventors: Wilhelm Wertelewski; Jorg Schade, both of Datteln, Germany

[73] Assignee: Becorit Grubenausbau GmbH, Recklinghausen, Germany

[22] Filed: Feb. 28, 1975

[21] Appl. No.: 554,025

[30] Foreign Application Priority Data

Apr. 8, 1974 Germany ..... 2417048

[52] U.S. Cl. ..... 61/45 D

[51] Int. Cl.[2] ..... E21D 15/44

[58] Field of Search ..... 61/45 D; 299/31, 33; 248/357; 91/170 MP

[56] References Cited

FOREIGN PATENTS OR APPLICATIONS

| | | | |
|---|---|---|---|
| 1,503,990 | 10/1967 | France | 61/45 D |
| 1,232,911 | 1/1967 | Germany | 61/45 D |
| 1,218,982 | 6/1966 | Germany | 61/45 D |
| 125,227 | 1960 | U.S.S.R. | 61/45 D |

*Primary Examiner*—Dennis L. Taylor

*Attorney, Agent, or Firm*—Berman, Aisenberg & Platt

[57] ABSTRACT

A shield support assembly for underground mining operations having a caving shield supported from a ground-engaging structure by a support beam pivotally attached at opposite ends to the shield and the ground-engaging structure, the shield being also pivotally attached to such ground-engaging structure by a pivot which is displaceable longitudinally of such structure by pressure-fluid-operated ram means arranged to act between such structure and the shield, the pivot or an extension of the shield beyond the pivot.

8 Claims, 8 Drawing Figures

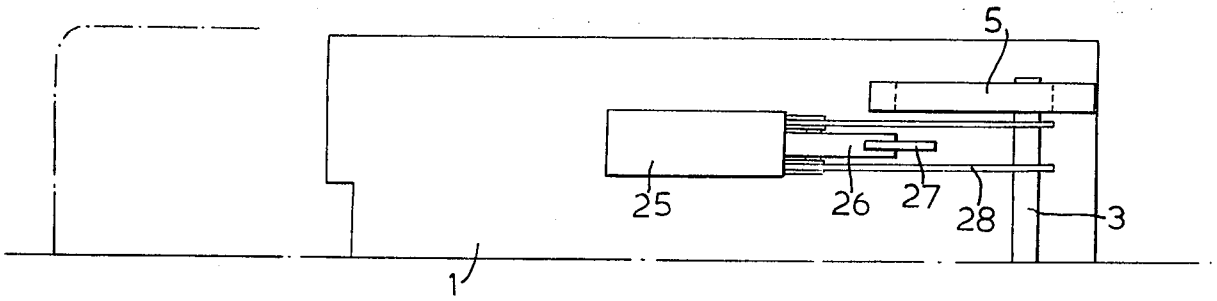
-FIG.8-

MINE SUPPORT ASSEMBLIES

The invention concerns a shield support assembly for the face support in underground mine operations. With the simplest constructional form of a shield support assembly, the caving shield is pivotable about a shaft arranged immovably on the base plate, in a vertical plane towards the caving shield. A roof bar can be arranged on the free end of the caving shield. The length of the caving shield, including the roof bar, is constant. The shield cylinder is arranged between the base plate and the caving shield. There is a course transposition between the shield cylinder and the free end of the caving shield or the roof bar arranged on the latter. This can be attributed to the fact that the shield cylinder acts between the free end and the rotation point of the one-arm lever formed by the caving shield (if necessary including the roof bar). Allowance must however be made for a force reduction; the resistance, which can be introduced into the roof by the roof bar, is always smaller than the force exerted by the shield cylinder. Nothing is altered when the shield cylinder is arranged on the shorter lever arm of a caving shield which is constructed as a bell crank lever. In this case the shield cylinder can be arranged horizontally and can be connected to a force direction reversing rod. Furthermore the shield support assemblies described above have the disadvantage that, when raising the shield, its free end or the roof bar attached to it, does not rise normal to the stratification but is removed from the working face. As this would lead to an insufficient support of the roof, this disadvantage cannot be tolerated. In order nevertheless to be able to use a shield support assembly at different heights, either the caving shield can be telescopically extended by a concealed connection or the rotation point of the caving shield can be displaced on the base plate towards the working face by a concealed connection. With a support chock it is also known to displace the rotation points of support struts arranged between roof bar and base plate continually towards the working face.

It is an object of the invention to create a shield support assembly in which the course transposition described above is available, so that one or several relatively short shield cylinders can be used, and in which, moreover, on raising the caving shield, the latter and the roof bar attached to it rise normal or almost normal to the stratification, so that at all heights the support of the roof takes place at a constant proximity to the working face. Moreover the shield support assembly should fulfil a further requirement which is particularly important with regard to the control of the roof. That is, it should exert a resistance, the magnitude of which increases with increasing support height.

According to the invention there is provided a shield support assembly for face support in underground mine operations, the caving shield of which is pivotable towards the base plate in a vertical plane about an axis which is movable in guides arranged on the base plate towards the coal face, and which is characterised by the fact that the swivel axis of the caving shield is displaceable towards the coal face by means of a pressure medium cylinder supported against the base plate, whilst on the coal face side the ends of a support beam are flexibly attached to the base plate and to the caving shield.

With the shield support assembly according to the invention the course transposition is available. The free end of the caving shield or the roof bar attached to the latter rise normal to the stratification when the caving shield rises. The resistance which the roof plate can introduce into the roof increases when the caving shield rises, thus with increased height, and the increase even then exceeds the linear ratio.

The underlying concept of the invention can also be carried out in such a way that the swivel point of the caving shield on the base plate is not displaceable. The swivel point of the support beam on the base plate can be displaced and the shield cylinder can act there. Then however one must forego the advantage that the free end of the caving shield rises normal to the stratification.

It is appropriate to construct the shield support assembly in such a way that the goaf-side angle between the base plate and support beam does not amount to more then 90° in any operating position of the caving shield. In a preferred embodiment the guide arrangement for the swivel axis of the caving shield runs parallel to the base plate.

An arrangement of the shield cylinder or cylinders in which the latter constrict the free face excavation as little as possible, can be attained by the fact that a pressure-medium cylinder arrangement exerting traction force is used as shield cylinder, which is attached flexibly on one hand to the swivel axis and on the other hand to an abutment arranged on the face side on the base frame. The support height of the shield cylinder or cylinders can if necessary be reduced by the fact that it is a question with them of piston cylinder arrangements which extend on the introduction of pressure-medium, but are connected to a force direction reversing rod.

A further enlargement of the free face excavation can be attained in that the caving shield is extended beyond the swivel axis into a two-armed lever, to the second arm of which a pressure medium cylinder arrangement exerting traction force and acting as shield cylinder is attached, which on the other side is connected to the base frame. Appropriately the angle pointing towards the base plate, between the caving shield and the second arm should thus be smaller than 180°. Instead of the pressure-medium cylinder arrangement exerting traction force a piston cylinder arrangement extending on introduction of pressure-medium can be used, which is connected to a force direction reversing rod.

In a further embodiment a pressure-medium cylinder can act as shield cylinder which is pivotably attached on the one hand to the base plate and on the other hand to the caving shield, wherein the coal face side angle between base plate and pressure-medium cylinder is no larger than 90° in any operating position of the caving shield. The pressure-medium cylinder and the support beam can thus be articulated to the same point of the caving shield. A pressure-medium cylinder can also be used as shield cylinder, which is pivotably attached on one side to the base plate and on the other side to the support beam.

Embodiments of the shield support assembly according to the invention are described below with the reference to the drawing.

Figure 1:
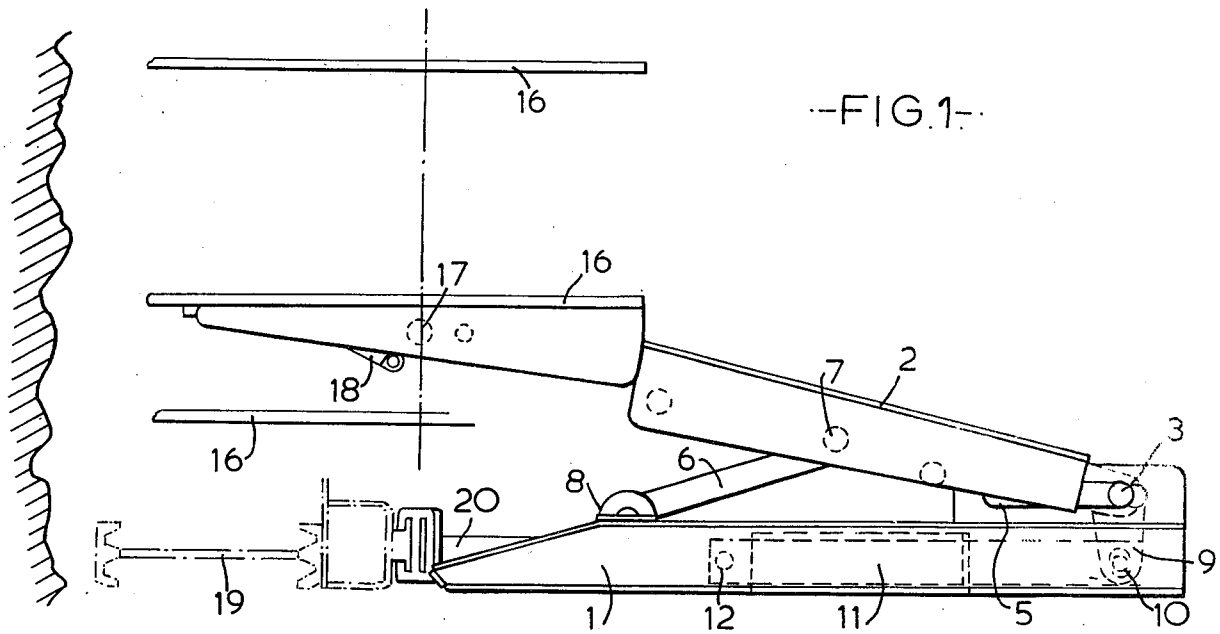
FIG. 1 shows a side view.
Figure 2:
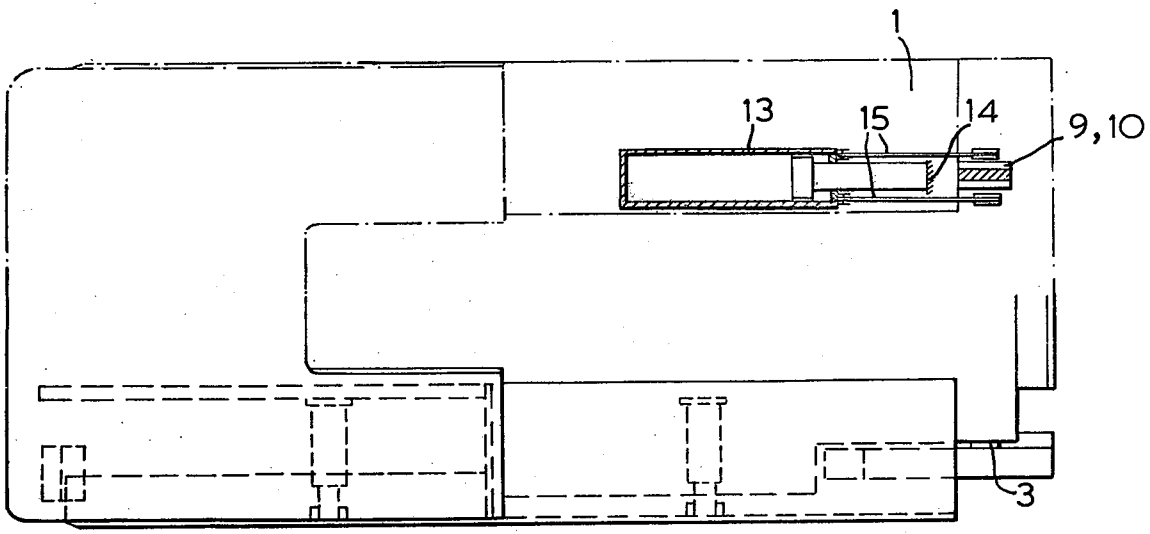
FIG. 2 shows a partially cut view.
Figure 3:
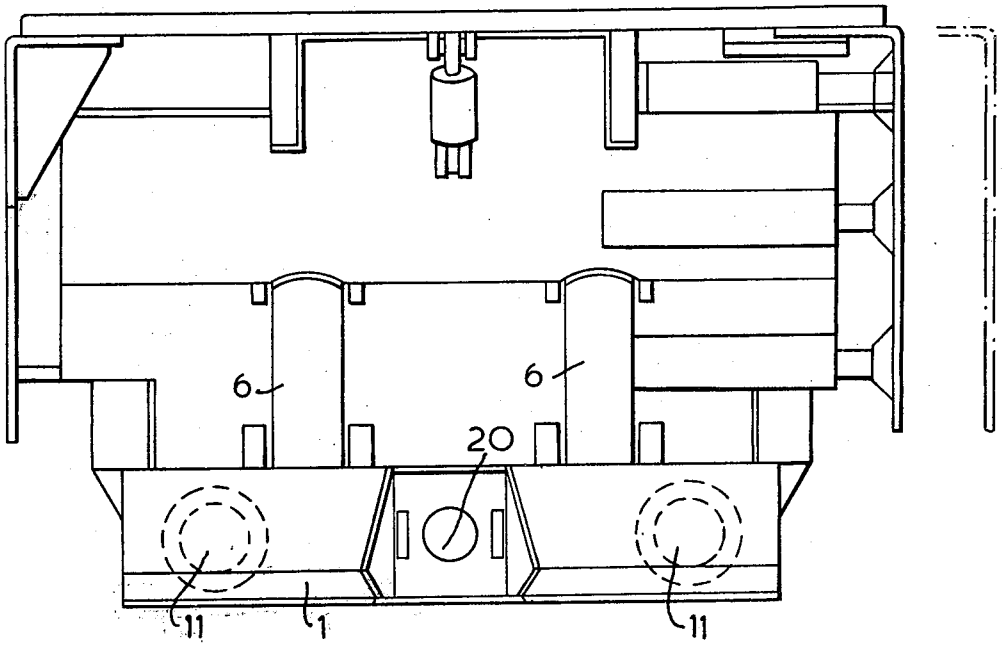
FIG. 3 shows a front view of a first embodiment.

In the shield support assembly shown in FIGS. 1, 2 and 3 the base plate is marked 1. The caving shield 2 is flexibly connected to the base plate 1 so that it is pivotable towards the base plate in a vertical plane. The connection takes place through bolts 3, attached to the caving shield 2, which are arranged rotating and displaceable towards the coal face 4, in slot guides 5. The slot guides 5 are connected firmly to the base plate 1. Support beams 6 are arranged between the caving shield 2 and the base plate 1. The ends of the support beams 6 are located pivotable on bolts 7 or 8, which for their part are firmly connected to the caving shield 2 or the base plate 1.

The caving shield 2 is extended beyond the swivel bolts 3 into a bell-crank lever. The second lever arm 9 is bent towards the caving shield 2 and to its free end pointing towards the base plate 1, two pressure-medium cylinder arrangements 11 acting as shield cylinders are attached at 10, the other ends of which are attached to the base plate 1. The pressure-medium cylinder arrangements, as shown in FIG. 1, could consist of pressure-medium cylinders, the piston rods of which are retracted into the cylinder on introduction of pressure-medium. In this case the pressure-medium cylinder would be connected at 12 to the base plate. In FIG. 2 however pressure-medium cylinders are used, the piston rods of which extend out of the cylinder on introduction of pressure-medium. The piston rods of the cylinders 13 are connected to the base plate 1 at 14, whilst the cylinders 13 are connected to the second lever arm 9 at 10 by tie rods 15. Each of the two pressure-medium cylinder arrangements described above by way of the FIG. 1 and 2 has the effect on activation with pressure-medium that the swivel bolts 3 of the caving shield 2 are displaced in the slot guides 5 towards the coal face. At the same time the free end of the caving shield 2 with the roof bar 16 arranged on it is removed from the base plate 1 towards the roof. The coal face side edge of the roof bar 16 does not thus exactly follow an arc, but it moves in a plane normal to the stratification without altering its distance from the coal face. During the upward motion of the roof bar 16 the acute angle enclosed between the support beams 6 and the base plate 1 is increased until the support beams 6 are normal or almost normal to the stratification.

The roof bar 16 is connected, pivotable about a pin, at 17 to the caving shield 2 and the positioning of the roof bar takes place by a pressure-medium cylinder 18 acting between the caving shield 2 and the roof bar 16. For the connection of the shield support assembly to a face conveyor 19 a double-acting pressure-medium cylinder 20 is used which is arranged in the base plate 1 and is connected on one side to the face conveyor 19 and on the other side to the base plate 1.

Figure 4:
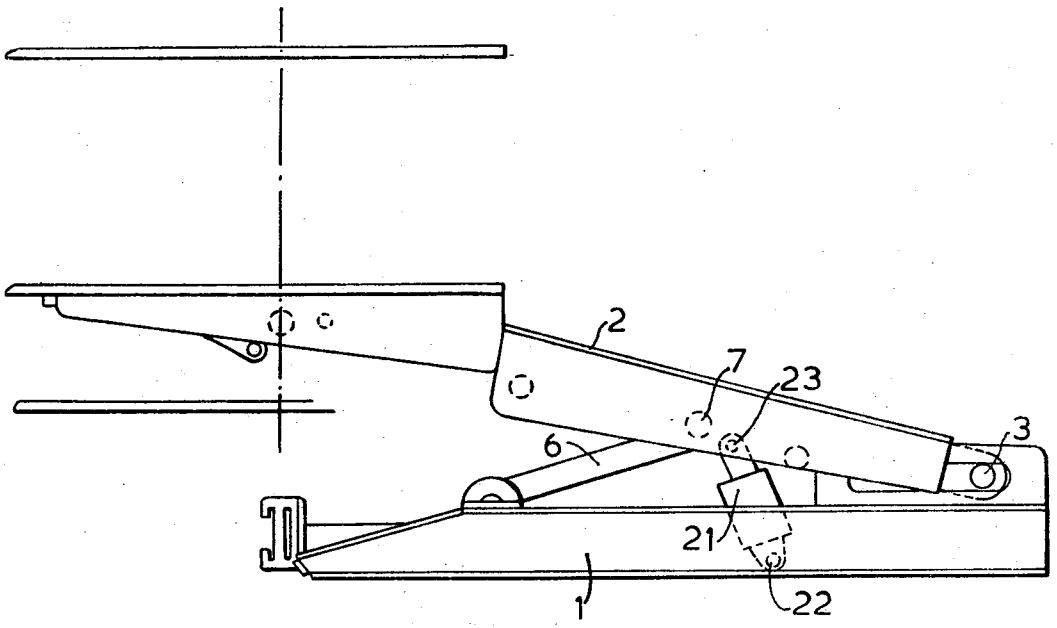
FIGS. 4, 5 and 6 show a side view of further embodiments.

With the embodiment shown in FIG. 4 a pressure-medium cylinder 21 acts as shield cylinder, which is pivotably attached on one side to the base plate 1 and on the other side to the caving shield 2. On the base plate 1 the attachment point lies at the coal face side of the swivel bolt 3 of the caving shield 2; the attachment point 23 lies between the swivel bolt 3 and the articulation point 7 of the support beam 6.

Figure 5:
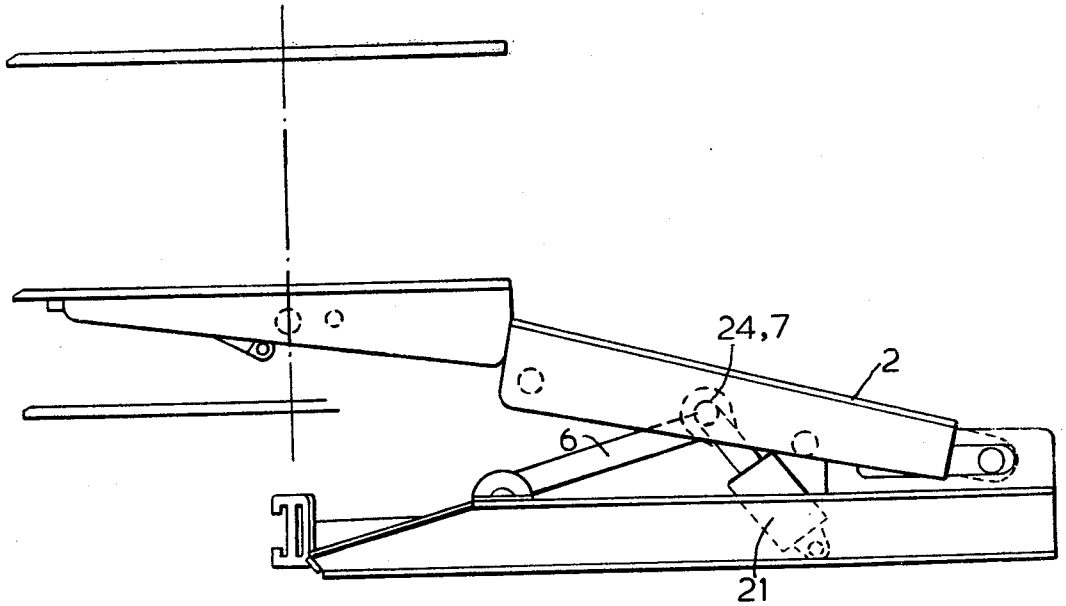

The embodiment shown in FIG. 5 differs from the above in that the contact point 24 of the pressure-medium cylinder acting as shield cylinder, on the caving shield 2 coincides with the contact point 7 of the support beam 6.

Figure 6:
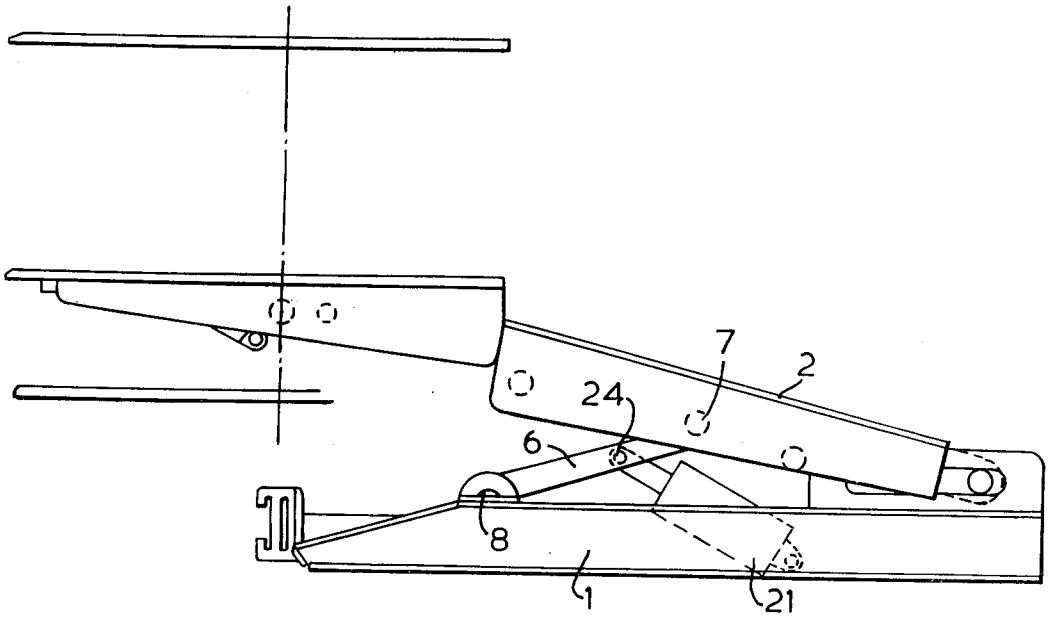

With the embodiment shown in FIG. 6 the pressure-medium cylinder acting as shield cylinder is attached to the base plate 1, as described with reference to FIGS. 4 and 5, whilst the other end of the cylinder 21 is attached to the support beam 6 at 24, therefore between its end points 7 and 8.

Figure 7:
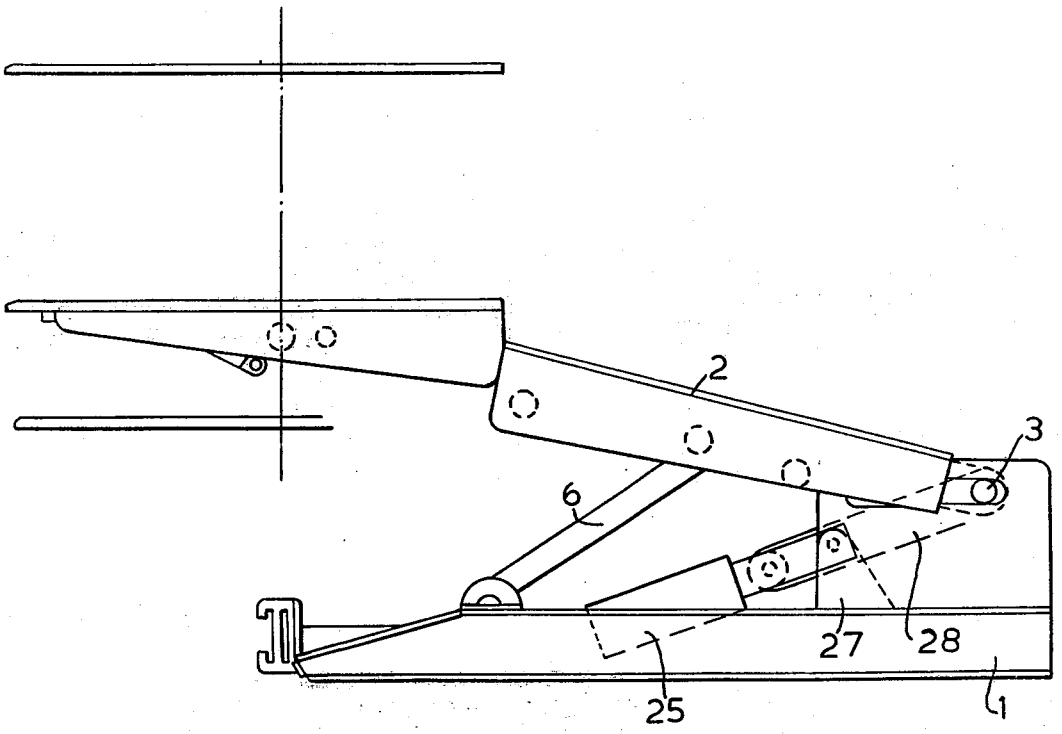
FIG. 7 shows a side view of a fifth embodiment, and in FIG. 8 the shield cylinder of the embodiment according to FIG. 7 is shown in partial section.

With the embodiments shown in FIG. 7 and 8 two pressure-medium cylinders 25 are used as shield cylinders, the piston rods 26 of which are articulated to abutments 27 firmly connected to the base plate, whilst tie rods 28 attached to the cylinders 25 are attached to the swivel bolts 3 of the caving shield 2.

With all embodiments it is to be recognised that when raising the caving shield the length ratio — projected on the base plate 1 — of the distances between the articulation point 8 of the support beam 6 to the base plate 1 and the articulation point 7 of the support beam 6 to the caving shield on the one hand and on the other hand between the said point 7 and the articulation point 3 of the caving shield 2 on the base plate varies. The alteration of the ratio ensues in sush a way that the length projected on the base plate of the support beam (between 8 and 7) decreases more quickly than the section — projected on the base plate — of the caving shield 2, which is located between the contact point 7 of the support beam and the swivel point 3. This has the consequence that the ratio of the force exerted by the shield cylinder to the force introduced into the roof increases whilst the roof bar is removed from the base plate. In practice considerable overproportional increases of the resistances with the seam thickness can be attained. A shield support assembly according to the invention can exert, with a seam thickness of 2 m, about four times the resistance (e.g. 50 $Mp/m^2$) which it exerts in a seam of 1 m thickness (13 $Mp/m^2$).

We claim:

1. A shield support assembly for underground mining operations, said assembly comprising:
   - a ground-engaging structure;
   - a roof-engaging structure;
   - a caving shield pivotally connected near its upper end to the roof-engaging structure and near its lower end to the ground-engaging structure by a pivot mounting displaceable longitudinally of the ground-engaging structure;
   - a support beam pivotally connected at its lower end to the ground-engaging structure and at its upper end to the caving shield to rotate the shield in the pivot mounting and relative to the ground-engaging structure when the pivot mounting is displaced longitudinally of the ground-engaging structure;
   - and pressure-fluid-operated ram means pivotally connected between the ground-engaging structure and the caving shield to displace the pivot mounting longitudinally of the ground-engaging structure so as to move the support beam to rotate the shield and raise and lower the roof-engaging structure.

2. A shield support assembly according to claim 1 wherein said ram means and said support beam are pivotally connected to said shield at the same point on said shield.

3. A shield support assembly according to claim 1 wherein said shield extends beyond said pivot mounting as a bell-crank lever and said ram means is pivotally connected at one end to the free end of said lever.

4. A shield support assembly according to claim 1 wherein said ram means is pivotally connected at its other end to said pivot mounting.

5. A shield support assembly according to claim 1 wherein said ram means is pivotally connected at its other end to said support beam.

6. A shield support assembly according to claim 1 wherein said ground-engaging structure includes guide means extending longitudinally thereof parallel to the base of said structure and said pivot mounting is displaceable in said guide means to an extent such that the angle between said support beam and said ground-engaging structure on the side facing said pivot mounting cannot exceed 90° during operation of said ram means.

7. A shield support assembly according to claim 1 wherein said ram means is connected to said caving shield by a force direction reversing rod.

8. A shield support assembly according to claim 1, wherein said ram means is pivotally connected at one end to the ground-engaging structure and is pivotally connected at the other end directly to said shield.

* * * * *